US005445768A

United States Patent [19]

Hauber et al.

[11] Patent Number: 5,445,768

[45] Date of Patent: Aug. 29, 1995

[54] METHOD AND DEVICE FOR MANUFACTURING A SPUN FLEECE

[75] Inventors: Michael Hauber, Weinheim; Ulrich Freudenberg, Sinsheim; Christoph Josefiak, Rimbach; Peter Barth, Birkenau; Bernd Dietrich, Aachern, all of Germany

[73] Assignee: Firma Carl Freudenberg, Weinheim, Germany

[21] Appl. No.: 165,229

[22] Filed: Dec. 10, 1993

[30] Foreign Application Priority Data

Dec. 10, 1992 [DE] Germany ..... 42 41 517.9

[51] Int. Cl.[6] ..... B29B 9/06

[52] U.S. Cl. ..... 264/6; 55/DIG. 5; 55/DIG. 39; 264/8; 264/114; 264/DIG. 48; 425/8; 156/167; 156/169

[58] Field of Search ..... 55/DIG. 5, DIG. 39; 264/6, 8, 114, DIG. 48; 425/8, 81.1, 83.1; 156/167, 179

[56] References Cited

U.S. PATENT DOCUMENTS 3,388,194 6/1968 Vinicki ..... 264/8
3,914,080 10/1975 Kamp ..... 425/83.1
4,178,157 12/1979 van Turnhout ..... 55/DIG. 39 X
4,215,682 8/1980 Kubik et al. ..... 55/DIG. 39 X
4,375,718 3/1983 Wadsworth et al. ..... 55/DIG. 5 X
4,865,790 9/1989 Sugimoto et al. ..... 264/131
4,937,020 6/1990 Wagner et al. ..... 264/6
4,973,440 11/1990 Tamura et al. ..... 264/114

FOREIGN PATENT DOCUMENTS 1560800 7/1971 Germany .

*Primary Examiner*—David A. Simmons
*Assistant Examiner*—Steven J. Helmer
*Attorney, Agent, or Firm*—Kenyon & Kenyon

[57] ABSTRACT

Method and device for manufacturing a flat textile structure in which two melts of at least two polymer materials are changed to the form of fibers with the aid of a spinning device and in which fibers are then combined and then solidified. The spinning device consists of a spinning rotor and the polymer materials employed have an charge difference of at least ten unit charges. The two materials are first melted separately from one another. Each melt, by means of a distributor device, is then fed to a group of outlet openings of a spinning rotor unmixed. The fibers emerging from the outlet openings are then stretched and combined to form a common flat structure with the flat structure then being charged triboelectrically by an aftertreatment.

10 Claims, 4 Drawing Sheets

METHOD AND DEVICE FOR MANUFACTURING A SPUN FLEECE

This application is related to U.S. application Ser. No. 08/166,056 to Hauber et al. filed on Dec. 10, 1993 entitled METHOD AND APPARATUS FOR MANUFACTURING TEXTILE.

RELATED APPLICATION

This application is related to an application entitled "Method and Apparatus for Manufacturing Textile" which claims priority from German P4241514.4 (M. Hauber et al.). The contents of the related application are incorporated herein by reference.

BACKGROUND OF THE INVENTION

The invention relates to a method for manufacturing a flat textile structure, in which at least two melts of at least two polymers are changed to the form of fibers with the aid of a spinning device, and in which the fibers are then combined and then solidified.

The general type of this method is known from DE-OS 15 60 800 (the contents of which are incorporated herein by reference). This method is suitable for manufacturing mixed-fiber fleece, with different polymers being spun alternately in the melt spinning method. Unfortunately, the filtration properties of the fleece produced by this method are not very satisfactory.

There remains a need for improvements to the known type of a method of manufacturing a spun fleece in such a way that filtration elements made of fiber fleece materials produced thereby exhibit good filtering properties across a long service life.

Devices configured for practicing this method generally comprise a spinning rotor, capable of being given a rotary motion around its axis, that has outlet openings in the vicinity of its circumferential surface. The rotor has first auxiliary means movable transversely with respect to the axis for continuously capturing the fibers emerging from the outlet openings.

Such a device is set forth in DE-OS 38 01 080, in which only one polymer is melted and fed under pressure into the spinning rotor. The molten streams emerging from the outlet openings are deflected by a blower, stretched, and laid down on a first auxiliary means, a backing fleece. Besides the disadvantage that the fleece formed by this device is not suitable as filter fleece, since it does not guarantee a sufficiently high filter effect over a long service life, the reliability of the device is less satisfactory when used for the intended purpose. With increasing usage, the known device with pressurized feed of the melt into the spinning rotor has a tendency to develop leaks.

There remains a need for an improved rotor device that provides better operational characteristics across a long service life in the manufacture of filter fleeces that provides a high filter effect over a long service life.

SUMMARY OF THE INVENTION

The present invention meets these needs by providing a technique and apparatus for using a number of melts to produce fibers from which can be made durable filter textiles.

In the method according to the invention, a spinning device that includes a spinning rotor is used to mechanically form fibers of polymer materials that have an electrical potential difference of at least ten unit charges. The materials are melted separately from one another in a melt, and each melt is fed unmixed to a segregated area of outlet openings in the spinning rotor and is then fed through the openings. The fibers emerging from the spinning rotor are stretched and combine to form a common structure. The resulting structure is charged triboelectrically in an aftertreatment. It is advantageous in this connection that the different polymer materials employed have a charge difference which is as great as possible, one which is retained across a very long service life. The filtration effect is therefore approximately constant over the entire service life of the filter material. Polypropylene and polyacryl 6 are polymers which are preferred for use as such polymer pairs. After the two polymers have been laid down to form a homogeneous fleece and the fleece has been charged triboelectrically by mechanical aftertreatment (e.g., needling), the charge difference and the consequently desirable filter properties are retained for a long time. As a result of the frictional forces of the needling stage, electrical charges are produced in the filter fleece. The spinning rotor offers a variety of opportunities for producing triboelectric filter fleeces. In addition to the above-mentioned combination of materials, materials made of glass and polypropylene can also be used. Using glass balls poses no problems in this regard. In this process it is important for the fleece to be free of finishes, since this would favor leakage of charges. In addition to needling of the fleece web, for example, waterjet solidification is also possible in which the finish is simultaneously removed.

According to an advantageous embodiment, the melt can be fed through two separate distributor segments of a distributor device inside the spinning rotor to respective separate outlet openings abutting it in the radial direction, so that only the fibers of one material emerge from the outlet openings in the vicinity of each distributor segment. Reliable separation of the molten, different polymer materials is thereby ensured and premature mixing of the materials prior to their emergence and solidification is thereby reliably prevented.

The fibers can be impacted immediately after their emergence from the outlet openings in the still sticky state by an air stream in which solid dipolar particles have been scattered prior to its impact on the still sticky fibers, with the fibers then being exposed to ionizing radiation. The ionizing radiation forms filter-effective charges which remain effective even during prolonged use for filtration. The dipolar particles can consist, for example, of barium titanate, which form agglomerates at room temperature and thus neutralize their charge. If the particles are heated with the aid of the airflow to temperatures of above 120° C., they lose their charge. In this state the particles in a uniform distribution contact the still-plastic fiber surface facing the air stream and stick to it. This "pretzel" effect has the advantage that no separate adhesive is used that can adversely affect the filter capability of the structure. The filter effect of the fiber fleece improves further as the size of the particles applied increases.

After their shaping and solidification, the fibers can be laid down continuously and progressively on a backing fleece. Material webs thus processed can then be laminated, e.g., with a covering material, and rolled up at a winding station.

According to one embodiment the spinning rotor is provided with two separate groups of outlet openings for feeding two melts of different polymers, as well as a distributor device provided in the vicinity of the axis with respect to the spinning rotor for feeding the melts into the outlet openings, which are arranged in different radial planes surrounding the axis. A needling device is arranged with respect to the first auxiliary means for conveying backing material away from the rotor. It is advantageous in this regard that the different polymer melts be fed unmixed to the outlet openings of the spinning rotor and so pass through them. The fibers, which are then solidified to form a flat textile structure as they are laid down on a backing fleece, can thereby be charged triboelectrically especially well. A needling system is arranged with respect to the backing fleece. As a result of the needling of the fleece web in which the fibers each consist of only one polymer, electrostatic charges caused by the friction of the needling system remain nearly unchanged for an especially long service life. The filter effect of such fleeces is especially good.

According to an advantageous embodiment, the distributor device is metallic and disk-shaped, and is located concentrically and nonrotatably inside the spinning rotor. In addition to having good thermal resistance, such a distributor device can be manufactured economically.

The distributor device can have groove-shaped depressions in the vicinity of its two axial boundary surfaces, said depressions opening axially and radially in the direction of the spinning rotor. The essentially channel-shaped depressions are sealed off from one another, so that reliable separation of the two melts is assured. From the flow engineering standpoint, it is advantageous for the depressions to be expanded in a funnel-shaped manner in the radial direction proceeding outward from the axis of rotation.

According to another advantageous embodiment, the depressions are arranged essentially perpendicular to one another. When two polymers are used and melts are fed from an essentially central location into the distributor device, the melts, during proper use of the device, are each deflected alternately onto a 90° segment of the outlet openings, with the segments charged with the same melt being arranged opposite one another radially.

According to another embodiment, the outlet openings of the spinning rotor can be arranged in radial planes different from one another and surrounding the axis, with the outlet openings in one radial plane each being chargeable by only one melt. This design also produces fibers of different starting polymers emerging from the rotor that are not mixed, so that a good triboelectric charge can be built up on the fleece as it is laid down. Such electrostatic charges can remain on the fibers for a very long service life.

BRIEF DESCRIPTION OF THE DRAWINGS

The method and the device will now be described in greater detail with reference to the attached drawings.

DETAILED DESCRIPTION OF THE DRAWINGS

Figure 1:
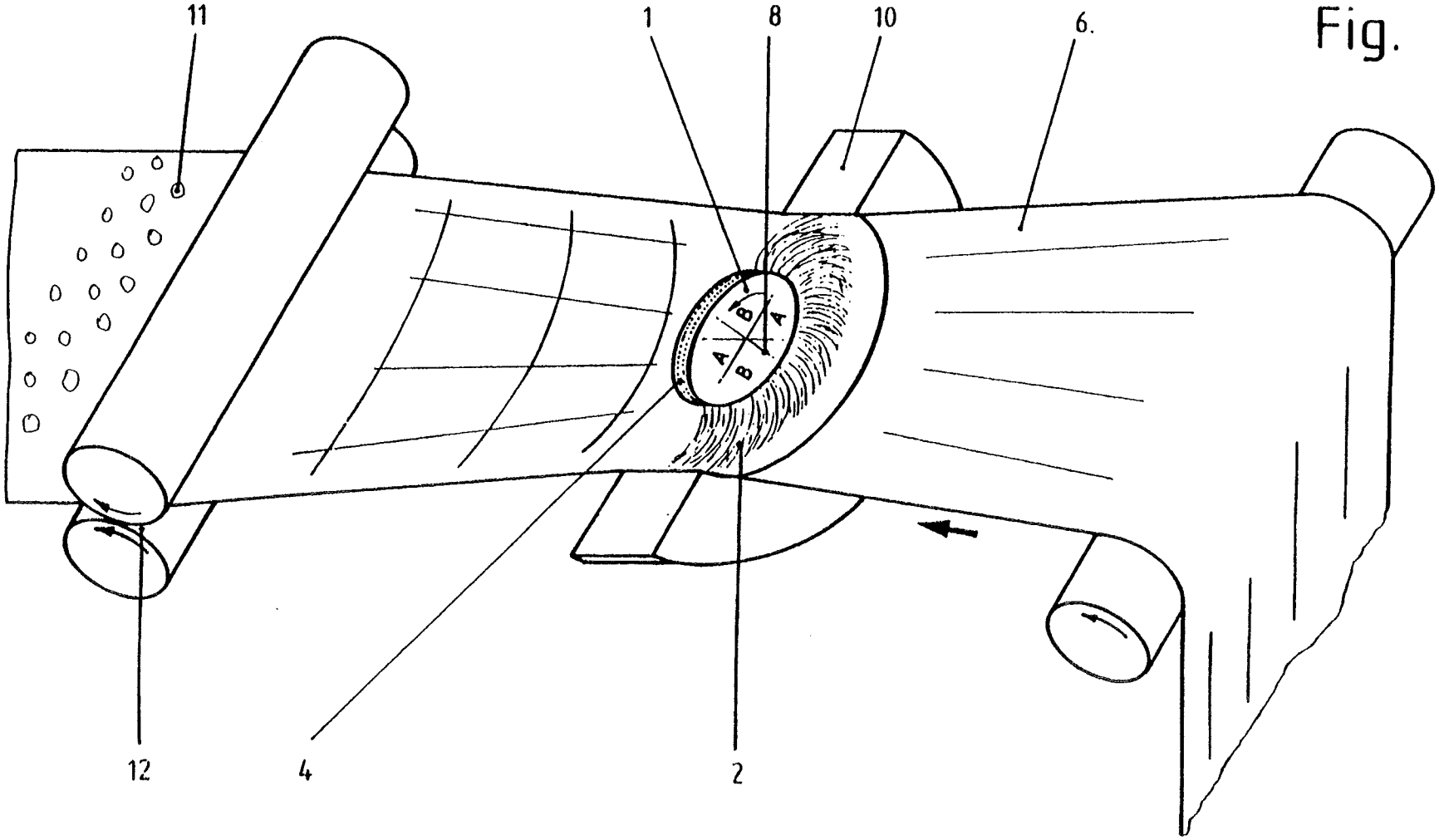
FIG. 1 shows an embodiment of the device according to the invention in a schematic representation.

FIG. 1 shows the device according to the invention in a schematic representation. For improved understanding, only the first backing fleece 6 is shown, which surrounds spinning rotor 1 along an essentially semicircular circumferential surface with radial spacing with respect thereto. A second backing fleece 7 that is used is arranged parallel to the first backing fleece 6 and surrounds the other half of spinning rotor 1 in the same manner, but is not shown here. The second half of suction hood 10, likewise not shown here, is similarly arranged relative to the second backing fleece 7.

A centrifugal force is exerted on the two polymer melts by the rotation of the spinning head. The melts collect only in the vicinity of the inner circumference of spinning rotor 1 allocated to them in front of outlet openings 4 and, depending on the rotational speed of spinning rotor 1 and the viscosity of the melt, are then forced through the outlet openings 4. In this embodiment, provision is made such that two melts A, B are used, and are fed unmixed to outlet openings 4 arranged along alternating 90° of arc of circumference of spinning rotor.

Figure 2:
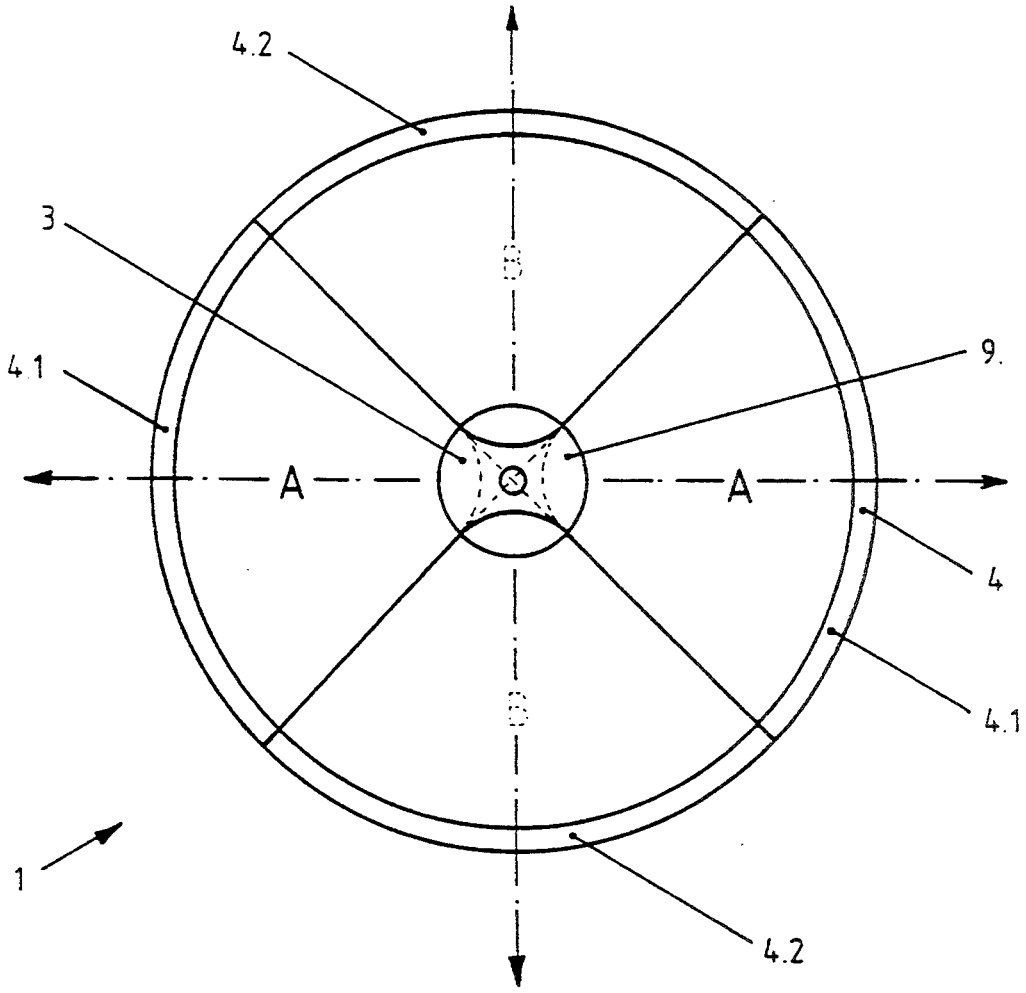
FIG. 2 shows the spinning rotor with built-in distributor device.
Figure 3:
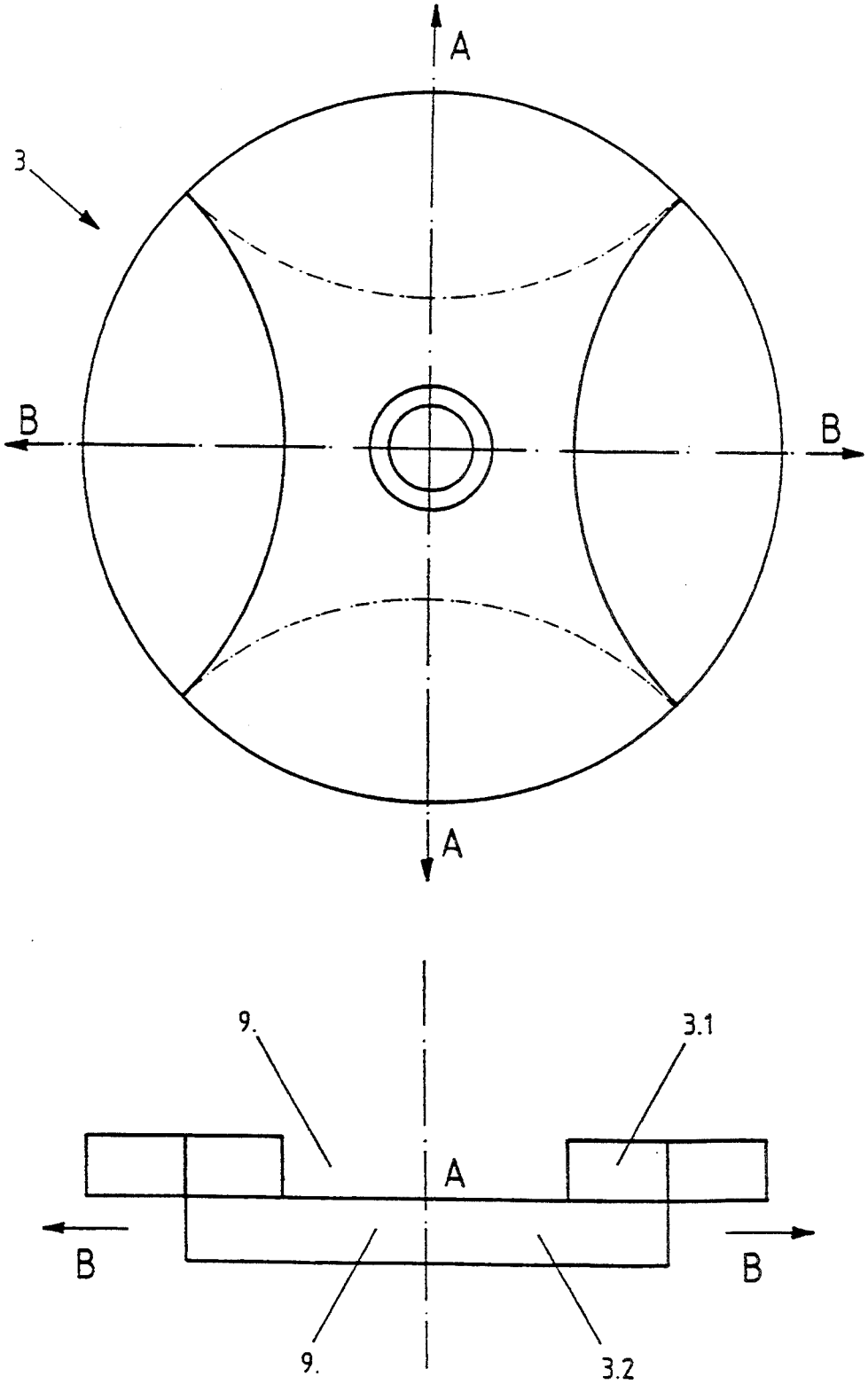
FIG. 3 is a two-part illustration showing the distributor device in plan view (upper half) and in and view (lower half)

Through distributor device 3 shown in FIGS. 2 and 3, fibers 2 of a material emerge on opposite sides of the circumference of spinning rotor 1 from outlet openings 4. The emerging still-plastic fibers 2 are stretched by the braking action of the air, centrifugal force, and their own inertia. Backing fleeces 6 and 7 move past outlet openings 4 in the direction of axis 8 of the spinning rotor 1, with the spinning rotor 1 being surrounded circumferentially by backing fleeces 6, 7 and a suction hood 10. Backing fleeces 6, 7 are located in the radial direction between spinning rotor 1 and bipartite suction hood 10. Under the suction action of suction hood 10, fibers 2, after solidifying, are laid down continuously and progressively on backing fleeces 6 and 7. In roller nip 12, the two coated material webs are laminated and then needled. The needles 11 employed to this end are shown schematically in FIG. 1.

The mechanical aftertreatment of needling the polymers, combined with their high charge difference in their original state, results in the filter fleece developing a triboelectric charge, with the electrostatic charges producing a good filter effect over a long service life.

In FIG. 2 spinning rotor 1 is shown schematically, and has along its outer circumference a ring with outlet openings 4. Metallic distributor device 3 is integrally mounted concentrically and nonrotatably inside the spinning rotor 1. Channel-shaped depressions 9 are arranged in different radial planes, with the feed of the two melts occurring into its own respective radial planes. In this embodiment the streams of polymer melts A and B are arranged perpendicular to one another and extend essentially along the axes of symmetry. Melts A and B alternately impact two opposed quarters of the outer circumference of spinning rotor 1. It is important to note in this regard that respective outlet openings 4 receive the melt of only one polymer, and mixing of the two distinct melts within the spinning rotor 1 is reliably prevented.

In FIG. 3 distributor device 3 is shown as an individual part. Channel-shaped depression 9 can be seen, into which the melts of polymers A and B are fed and delivered in the radial direction upon rotation of distributor device 3 with spinning rotor 1. Perpendicular to the stream of melt A, in a lower radial plane, the melt stream of material B is fed in the direction of outlet openings 4. In this embodiment, provision is made such that two melts A and B are used, each being fed to two circumferential segments of spinning rotor 1 as shown in FIG. 2. Different designs are also possible.

Figure 4:
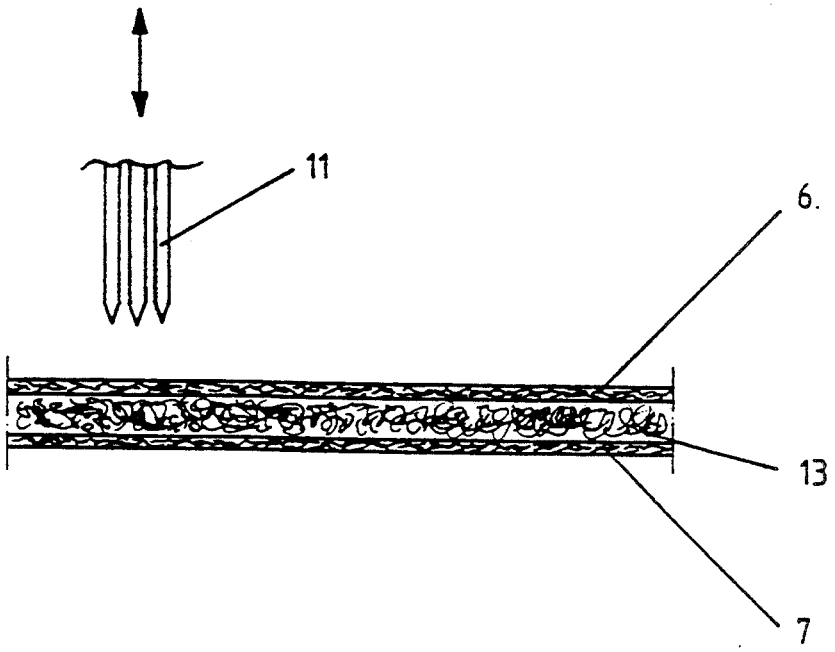
FIG. 4 shows the structure of the filter fleece and the needling device shown schematically.

FIG. 4 shows the design of the filter material according to the invention. A layer of very fine fiber fleece 13 is embedded between backing fleeces 6 and 7, said fleece 13 being triboelectrically chargeable by needles 11 of a needling device shown schematically here. Needles 11 of the needling device move in the direction shown by the double arrow, alternately into the filter material and then out again.

We claim:

1. A method for manufacturing a flat textile structure, comprising the steps of:

providing two separate melts, each of which has a polymeric composition distinct from the other melt;

supplying each melt, unmixed with the other melt, through a distributor concentrically located within a spinning rotor and rotating therewith, wherein within the distributor the melts are first fed to two separate disk-shaped distributor segments having the form of recesses that are open both axially and with respect to their circumferential perimeter and then feeding each of the separate melts to respectively adjoining outlet openings on the periphery of the rotor in the radial direction, so that only fibers of one composition emerge from the outlet openings associated with each distributor segment, whereby fibers are spun out from each opening of the rotor and each fiber is made of one of the two polymeric compositions, unmixed with the other;

permitting the fibers to solidify and become stretched and to combine to form a common flat structure; and triboelectrically charging the flat structure so formed, wherein the polymer compositions employed have a charge difference of at least ten unit charges.

2. The method according to claim 1, further comprising the steps of:

providing an air stream with solid dipolar particles;

directing the air stream containing solid dipolar particles onto the emerging fibers while the fibers are sticky so as to coat the fibers with the particles; and subjecting the fibers to an ionizing radiation.

3. The method according to claim 1, wherein the fibers, after their shaping and solidification, are laid down continuously and progressively onto a backing fleece.

4. The method according to claim 1, wherein the flat structure is triboelectrically charged by needling.

5. An apparatus for manufacturing a flat textile structure, comprising:

a spinning rotor displaceable in a rotary motion around its axis, said spinning rotor having outlet openings in the vicinity of its circumferential surface, said rotor having at least two separated groups of peripheral regions for receiving at least two separate melts, each region having its own outlets;

first auxiliary means, movable parallel to the axis, for continuously capturing fibers emerging from the outlet openings;

a disk-shaped distributor device arranged concentrically inside and relatively nonrotatably with respect to the spinning rotor for feeding the melts into outlet openings arranged in different radial planes surrounding the axis, wherein the distributor device has groove-shaped depressions in the vicinity of its axial boundary surfaces, said depressions opening axially and radially in the direction of the spinning rotor; and a needling device located adjacent to the first auxiliary means.

6. The apparatus according to claim 5, wherein the distributor device is made of metal.

7. The apparatus according to claim 5, wherein the depressions extend from the axis in the radial direction and expand funnelwise.

8. The apparatus according to claim 5, wherein the depressions are arranged essentially perpendicular to one another.

9. The apparatus according to claim 5, wherein the outlet openings of the spinning rotor are arranged in different radial planes surrounding the axis, and wherein the outlet openings of one radial plane are associated with only one depression in the distributor device.

10. The apparatus according to claim 6, wherein the outlet openings of the spinning rotor are arranged in different radial planes surrounding the axis, and wherein the outlet openings of one radial plane are associated with only one depression in the distributor device.

* * * * *